US006163769A

United States Patent [19]

Acero et al.

[11] Patent Number: 6,163,769

[45] **Date of Patent: *Dec. 19, 2000**

[54] TEXT-TO-SPEECH USING CLUSTERED CONTEXT-DEPENDENT PHONEME-BASED UNITS

[75] Inventors: Alejandro Acero, Redmond; Hsiao-Wuen Hon; Xuedong D. Huang, both of Woodinville, all of Wash.

[73] Assignee: Microsoft Corporation, Redmond, Wash.

[ * ] Notice: This patent issued on a continued prosecution application filed under 37 CFR 1.53(d), and is subject to the twenty year patent term provisions of 35 U.S.C. 154(a)(2).

[21] Appl. No.: 08/949,138

[22] Filed: Oct. 2, 1997

[51] Int. Cl.[7] ..... G10L 13/00

[52] U.S. Cl. ..... 704/260; 704/243; 704/244; 704/245; 704/255; 704/256; 704/257; 704/258; 704/260; 704/266; 704/267; 704/268; 704/269

[58] Field of Search ..... 704/243–245, 704/255–257, 258, 260, 266–269

[56] References Cited

U.S. PATENT DOCUMENTS

| | | | |
|---|---|---|---|
| 4,852,173 | 7/1989 | Bahl et al. | 381/43 |
| 4,979,216 | 12/1990 | Malsheen et al. | 381/52 |
| 5,153,913 | 10/1992 | Kandefer et al. | 381/51 |
| 5,384,893 | 1/1995 | Hutchins | 704/267 |
| 5,636,325 | 6/1997 | Farrett | 704/258 |
| 5,794,197 | 8/1998 | Alleva et al. | 704/255 |

OTHER PUBLICATIONS

Nakajima, S., Hamada, H., "Automatic Generation of Synthesis Units Based on Context Oriented Clustering", IEEE International Conference on Acoustics, Speech, and Signal Processing, New York, Apr. 1988, pp. 659–662.

Ney, H., Heab–Umbach, R., Tran, B.H., Oerder, M., "Improvements in Beam Search for 10000–Word Continuous Speech Recognition", IEEE International Conference on Acoustics, Speech, and Signal Processing, California, Mar. 1992, pp. I–9—I–12.

Emerard, F., Mortamet, L., Cozannet, A., "Prosodic processing in a text–to–speech synthesis system using a database and learning procedures", Talking Machines: Theories, Models, and Designs, 1992, pp. 225–254.

Riley, M., "Tree–based modelling of segmental durations", Talking Machines: Theories, Models, and Designs, 1992, pp. 265–273.

Hwang, M.Y., Huang X., Alleva, F., "Predicting Unseen Triphone with Senones", IEEE International Conference on Acoustics, Speech, and Signal Processing, Minnesota, Apr., 1993, pp. II–311—II–314.

(List continued on next page.)

*Primary Examiner*—David D. Knepper
*Attorney, Agent, or Firm*—Westman, Champlin & Kelly, P.A.; S. Koehler

[57] ABSTRACT

A text-to-speech system includes a storage device for storing a clustered set of context-dependent phoneme-based units of a target speaker. In one embodiment, decision trees are used wherein each decision tree based context-dependent phoneme-based unit is arranged based on context of at least one immediately preceding and succeeding phoneme. At least one of the context-dependent phoneme-based units represents other non-stored context-dependent phoneme units of similar sound due to similar contexts. A text analyzer obtains a string of phonetic symbols representative of text to be converted to speech. A concatenation module selects stored decision tree based context-dependent phoneme-based units from the set decision tree based context-dependent phoneme-based units based on the context of the phonetic symbols and synthesizes the selected phoneme-based units to generate speech corresponding to the text.

31 Claims, 4 Drawing Sheets

OTHER PUBLICATIONS

Donovan, R.E., Woodland, P.C., "Improvements in an HMM–Based Speech Synthesiser", Proceedings of European Conference on Speech Communication and Technology, Madrid, Spain, Sep. 1995, pp. 573–576.

Huang, X., Acero, A., Alleva F., Hwang, M.Y., Jiang, L., Mahajan, M., "Microsoft Windows Highly Intelligent Speech Recognizer: Whisper", IEEE International Conference on Acoustics, Speech, and Signal Processing, Detroit, 1995, pp. 1–5.

Alleva, F., Xuedong, H., Hwang, M.Y., "Improvements on the Pronunciation Prefix Tree Search Organization", IEEE International Conference on Acoustics, Speech, and Signal Processing, Georgia, May 1996, pp. 133–136.

Hsiao–Wuen et al., "CMU Robust Vocabulatory–Independent Speech Recognition System", IEEE International Conference on Acoustics, Speech and Signal Processing, Toronto, Canada, 1991, pp. 889–892.

Young et al., "Tree–Based State Tying for High–Accuracy Acoustic Modelling" ARPA Workshop on Human Language Technology, Merrill Lynch Conference Centre, pp 307–312, 1994.

FIG. 1 *PRIOR ART*

TEXT-TO-SPEECH USING CLUSTERED CONTEXT-DEPENDENT PHONEME-BASED UNITS

BACKGROUND OF THE INVENTION

The present invention relates generally to generating speech using a concatenative synthesizer. More particularly, an apparatus and a method are disclosed for storing and generating speech using decision tree based context-dependent phonemes-based units that are clustered based on the contexts associated with the phonemes-based units.

Speech signal generators or synthesizers in a text-to-speech (TTS) system can be classified into three distinct categories: articulatory synthesizers; formant synthesizers; and concatenative synthesizers. Articulatory synthesizers are based on the physics of sound generation in the vocal apparatus. Individual parameters related to the position and movement of vocal chords are provided. The sound generated therefrom is determined according to physics. In view of the complexity of the physics, practical applications of this type of synthesizer are considered to be far off.

Formant synthesizers do not use equations of physics to generate speech, but rather, model acoustic features or the spectra of the speech signal, and use a set of rules to generate speech. In a formant synthesizer, a phoneme is modeled with formants wherein each formant has a distinct frequency "trajectory" and a distinct bandwidth which varies over the duration of the phoneme. An audio signal is synthesized by using the frequency and bandwidth trajectories to control a formant synthesizer. While the formant synthesizer can achieve high intelligibility, its "naturalness" is typically low, since it is very difficult to accurately describe the process of speech generation in a set of rules. In some systems, in order to mimic natural speech, the synthetic pronunciation of each phoneme is determined by a set of rules which analyzes the phonetic context of the phoneme. U.S. Pat. No. 4,979,216 issued to Malsheen et al. describes a text-to-speech synthesis system and method using context dependent vowel allophones.

Concatenation systems and methods for generating text-to-speech operate under an entirely different principle. Concatenative synthesis uses pre-recorded actual speech forming a large database or corpus. The corpus is segmented based on phonological features of a language. Commonly, the phonological features include transitions from one phoneme to at least one other phoneme. For instance, the phonemes can be segmented into diphone units, syllables or even words. Diphone concatenation systems are particularly prominent. A diphone is an acoustic unit which extends from the middle of one phoneme to the middle of the next phoneme. In other words, the diphone includes the transition between each partial phoneme. It is believed that synthesis using concatenation of diphones provides good voice quality since each diphone is concatenated with adjoining diphones where the beginning and the ending phonemes have reached steady state, and since each diphone records the actual transition from phoneme to phoneme.

However, significant problems in fact exist in current diphone concatenation systems. In order to achieve a suitable concatenation system, a minimum of 1500 to 2000 individual diphones must be used. When segmented from prerecorded continuous speech, suitable diphones may not be obtainable because many phonemes (where concatenation is to be taken place) have not reached a steady state. Thus, a mismatch or distortion can occur from phoneme to phoneme when the diphones are concatenated together. To reduce this distortion, diphone concatenative synthesizers, as well as others, often select their units from carrier sentences or monotone speech, and/or perform spectral smoothing, all of which can lead to a decrease of naturalness. The resulting synthetic speech may not resemble the donor speaker. In addition, the other neighboring contextual influence of a diphone unit could seriously introduce potential distortion at the concatenation points.

Another known concatenative synthesizer is described in an article entitled "Improvements in an HMM-Based Speech Synthesizer" by R. E. Donovan et al., Proc. Eurospeech '95, Madrid, September, 1995. The system uses a set of cross-word decision-tree state-clustered triphone HMMs to segment a database into approximately 4000 cluster states, which are then used as the units for synthesis. In other words, the system uses a senone as the synthesis unit. A senone is a context-dependent sub-phonetic unit which is equivalent to a HMM state. During synthesis, each state is synthesized for a duration equal to the average state duration plus a constant. Thus, the synthesis of each phoneme requires a number of concatenation points. Each concatenation point can contribute to distortion.

There is an ongoing need to improve text-to-speech synthesizers. In particular, there is a need to provide an improved concatenation synthesizer that minimizes or avoids the problems associated with known systems.

SUMMARY OF THE INVENTION

An apparatus and a method for converting text-to-speech includes a storage device for storing a clustered set of context-dependent phoneme-based units of a target speaker. In one embodiment, decision trees are used wherein each decision tree based context-dependent phoneme-based unit represents a set of phoneme-based units with similar contexts of at least one immediately preceding and succeeding phoneme-based unit. A text analyzer obtains a string of phonetic symbols representative of text to be converted to speech. A concatenation module selects stored decision tree based context-dependent phoneme-based units from the set of phoneme-based units through a decision tree lookup based on the context of the phonetic symbols. Finally the system synthesizes the selected decision tree based context-dependent phoneme-based units to generate speech corresponding to the text.

Another aspect of the present invention is an apparatus and a method for creating context dependent synthesis units of a text-to-speech system. A storage device is provided for storing input speech from a target speaker and corresponding phonetic symbols of the input speech. A training module identifies each unique context-dependent phoneme-based unit of the input speech and trains a HMM. A clustering module clusters the HMMs into groups having the same central phoneme-based unit with different preceding and/or succeeding phonemes-based units that sound similar.

DETAILED DESCRIPTION OF THE PREFERRED EMBODIMENTS

Figure 1:
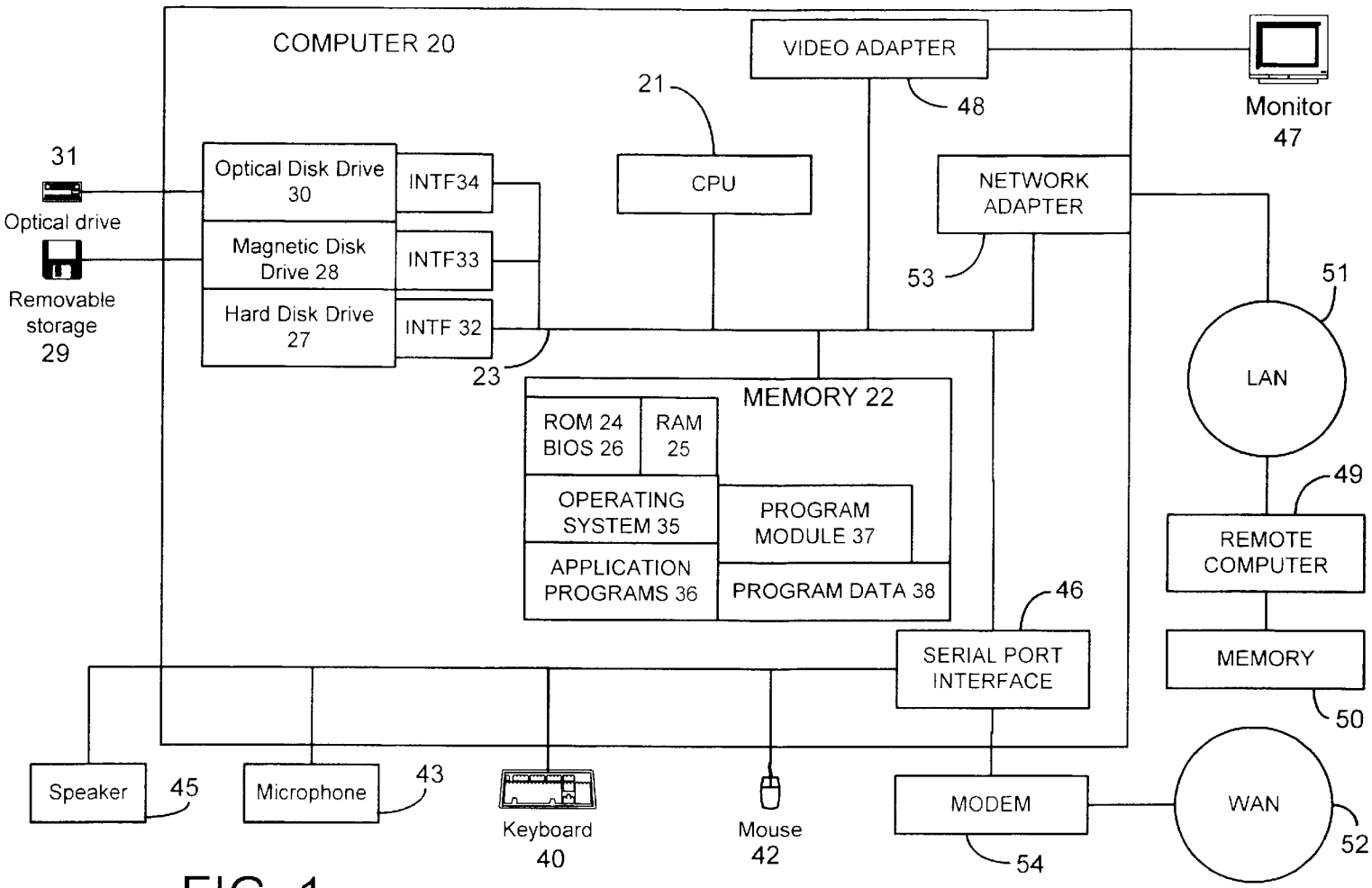
FIG. 1 is a block diagram of an exemplary environment for implementing a text-to-speech (TTS) system in accordance with the present invention.

FIG. 1 and the related discussion are intended to provide a brief, general description of a suitable computing environment in which the invention may be implemented. Although not required, the invention will be described, at least in part, in the general context of computer-executable instructions, such as program modules, being executed by a personal computer. Generally, program modules include routine programs, objects, components, data structures, etc. that perform particular tasks or implement particular abstract data types. Moreover, those skilled in the art will appreciate that the invention may be practiced with other computer system configurations, including hand-held devices, multiprocessor systems, microprocessor-based or programmable consumer electronics, network PCs, minicomputers, mainframe computers, and the like. The invention may also be practiced in distributed computing environments where tasks are performed by remote processing devices that are linked through a communications network. In a distributed computing environment, program modules may be located in both local and remote memory storage devices.

With reference to FIG. 1, an exemplary system for implementing the invention includes a general purpose computing device in the form of a conventional personal computer 20, including a processing unit (CPU) 21, a system memory 22, and a system bus 23 that couples various system components including the system memory 22 to the processing unit 21. The system bus 23 may be any of several types of bus structures including a memory bus or memory controller, a peripheral bus, and a local bus using any of a variety of bus architectures. The system memory 22 includes read only memory (ROM) 24 and random access memory (RAM) 25. A basic input/output (BIOS) 26, containing the basic routine that helps to transfer information between elements within the personal computer 20, such as during start-up, is stored in ROM 24. The personal computer 20 further includes a hard disk drive 27 for reading from and writing to a hard disk (not shown), a magnetic disk drive 28 for reading from or writing to removable magnetic disk 29, and an optical disk drive 30 for reading from or writing to a removable optical disk 31 such as a CD ROM or other optical media. The hard disk drive 27, magnetic disk drive 28, and optical disk drive 30 are connected to the system bus 23 by a hard disk drive interface 32, magnetic disk drive interface 33, and an optical drive interface 34, respectively. The drives and the associated computer-readable media provide nonvolatile storage of computer readable instructions, data structures, program modules and other data for the personal computer 20.

Although the exemplary environment described herein employs the hard disk, the removable magnetic disk 29 and the removable optical disk 31, it should be appreciated by those skilled in the art that other types of computer readable media which can store data that is accessible by a computer, such as magnetic cassettes, flash memory cards, digital video disks, Bernoulli cartridges, random access memories (RAMs), read only memory (ROM), and the like, may also be used in the exemplary operating environment.

A number of program modules may be stored on the hard disk, magnetic disk 29, optical disk 31, ROM 24 or RAM 25, including an operating system 35, one or more application programs 36, other program modules 37, and program data 38. A user may enter commands and information into the personal computer 20 through input devices such as a keyboard 40, pointing device 42 and a microphone 43. Other input devices (not shown) may include a joystick, game pad, satellite dish, scanner, or the like. These and other input devices are often connected to the processing unit 21 through a serial port interface 46 that is coupled to the system bus 23, but may be connected by other interfaces, such as a sound card, a parallel port, a game port or a universal serial bus (USB). A monitor 47 or other type of display device is also connected to the system bus 23 via an interface, such as a video adapter 48. In addition to the monitor 47, personal computers may typically include other peripheral output devices, such as a speaker 45 and printers (not shown).

The personal computer 20 may operate in a networked environment using logic connections to one or more remote computers, such as a remote computer 49. The remote computer 49 may be another personal computer, a server, a router, a network PC, a peer device or other network node, and typically includes many or all of the elements described above relative to the personal computer 20, although only a memory storage device 50 has been illustrated in FIG. 1. The logic connections depicted in FIG. 1 include a local area network (LAN) 51 and a wide area network (WAN) 52. Such networking environments are commonplace in offices, enterprise-wide computer network intranets and the Internet.

When used in a LAN networking environment, the personal computer 20 is connected to the local area network 51 through a network interface or adapter 53. When used in a WAN networking environment, the personal computer 20 typically includes a modem 54 or other means for establishing communications over the wide area network 52, such as the Internet. The modem 54, which may be internal or external, is connected to the system bus 23 via the serial port interface 46. In a network environment, program modules depicted relative to the personal computer 20, or portions thereof, may be stored in the remote memory storage devices. It will be appreciated that the network connections shown are exemplary and other means of establishing a communications link between the computers may be used.

Figure 2:
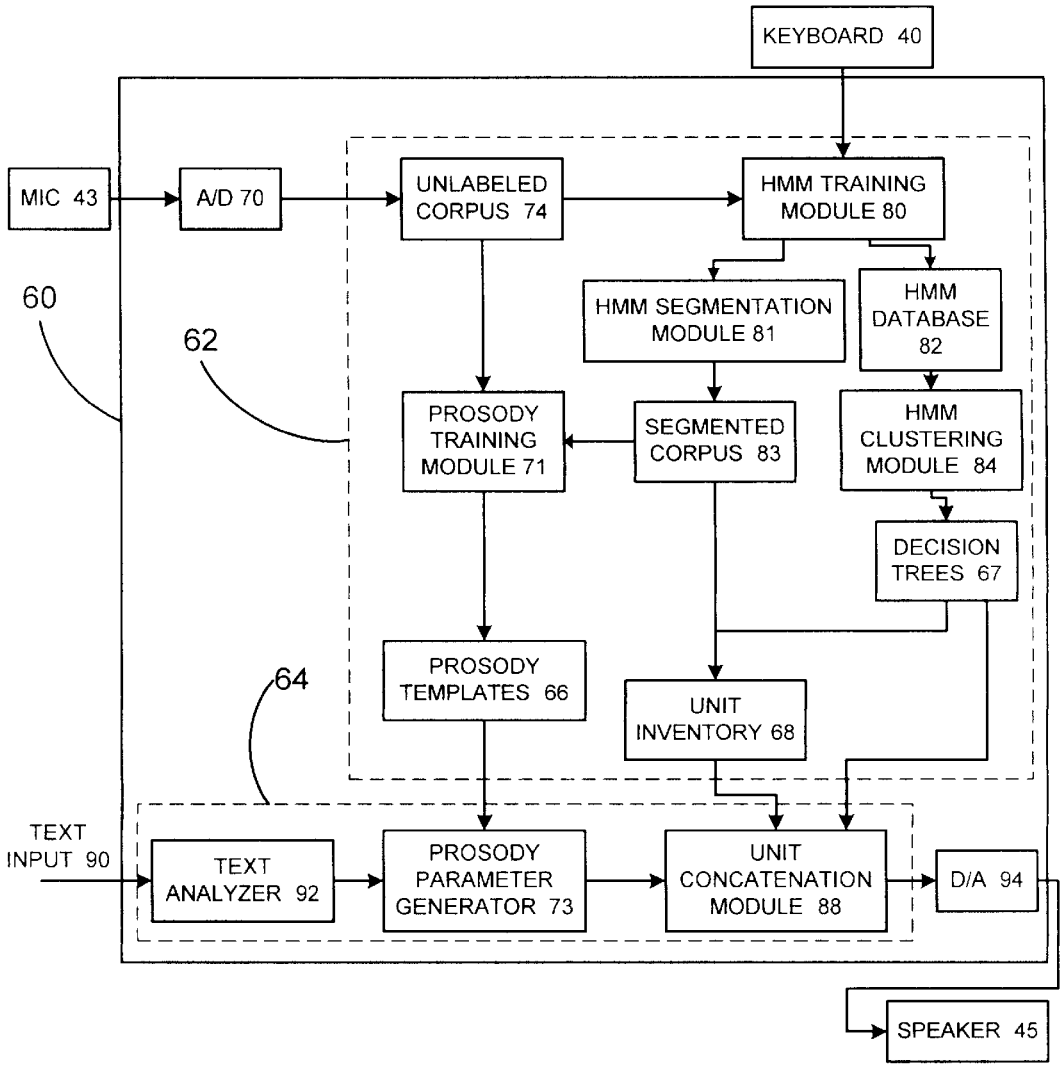
FIG. 2 is a more detailed diagram of the TTS system.

FIG. 2 illustrates a block diagram of text-to-speech (TTS) system 60 in accordance with an embodiment of the present invention. Generally, the TTS system 60 includes a speech data acquisition and analysis unit 62 and a run-time engine 64. The speech data acquisition and analysis unit 62 records and analyzes actual speech from a target speaker and provides as output prosody templates 66, a unit inventory 68 of representative phoneme units or phoneme-based sub-word elements and, in one embodiment, the decision trees 67 with linguistic questions to determine the correct representative units for concatenation. The prosody templates 66, the unit inventory 68 and the decision trees 67 are used by the run-time engine 64 to convert text-to-speech. It should be noted that the entire system 60, or a part of system 60 can be implemented in the environment illustrated in FIG. 1, wherein, if desired, the speech data acquisition and analysis unit 62 and run-time engine 64 can be operated on separate computers 20.

The prosody templates 66, an associated prosody training module 71 in the speech data acquisition unit 62 and an associated prosody parameter generator 73 are not part of the present invention, but are described in "Recent Improvements on Microsoft's Trainable Text-to-Speech System-Whistler", by X. D. Huang et al., IEEE International Conference on Acoustic, Speech and Signal Processing, Munich, Germany, April 1997, pp. 959–962, which is hereby incorporated by reference in its entirety. The prosody training module 71 and the prosody templates 66 are used to model prosodic features of the target speaker. The prosody parameter generator 73 applies the modeled prosodic features to the text to be synthesized.

In the embodiment illustrated, the microphone 43 is provided as an input device to the computer 20, through an appropriate interface and through an analog-to-digital converter 70. Other appropriate input devices can be used such as prerecorded speech as stored on a recording tape and played to the microphone 43. In addition, the removable optical disk 31 and associated optical disk drive 30, and the removable magnet disk 29 and magnetic disk drive 28 can also be used to record the target speaker's speech. The recorded speech is stored in any one of the suitable memory devices in FIG. 1 as an unlabeled corpus 74. Typically, the unlabeled corpus 74 includes a sufficient number of sentences and/or phrases, for example, 1000 sentences, to provide frequent tonal patterns and natural speech and to provide a wide range of different phonetic samples that illustrate phonemes in various contexts.

Upon recording of the speech data in the unlabeled corpus 74, the data in the unlabeled corpus 74 is first used to train a set of context-dependent phonetic Hidden Markov Models (HMM's) by a HMM training module 80. The set of models will then be used to segment the unlabeled speech corpus into context dependent phoneme units by a HMM segmentation module 81. The HMM training module 80 and HMM segmentation module 81 can either be hardware modules in computer 20 or software modules stored in any of the information storage devices illustrated in FIG. 1 and accessible by CPU 21 or another suitable processor.

Figure 3:
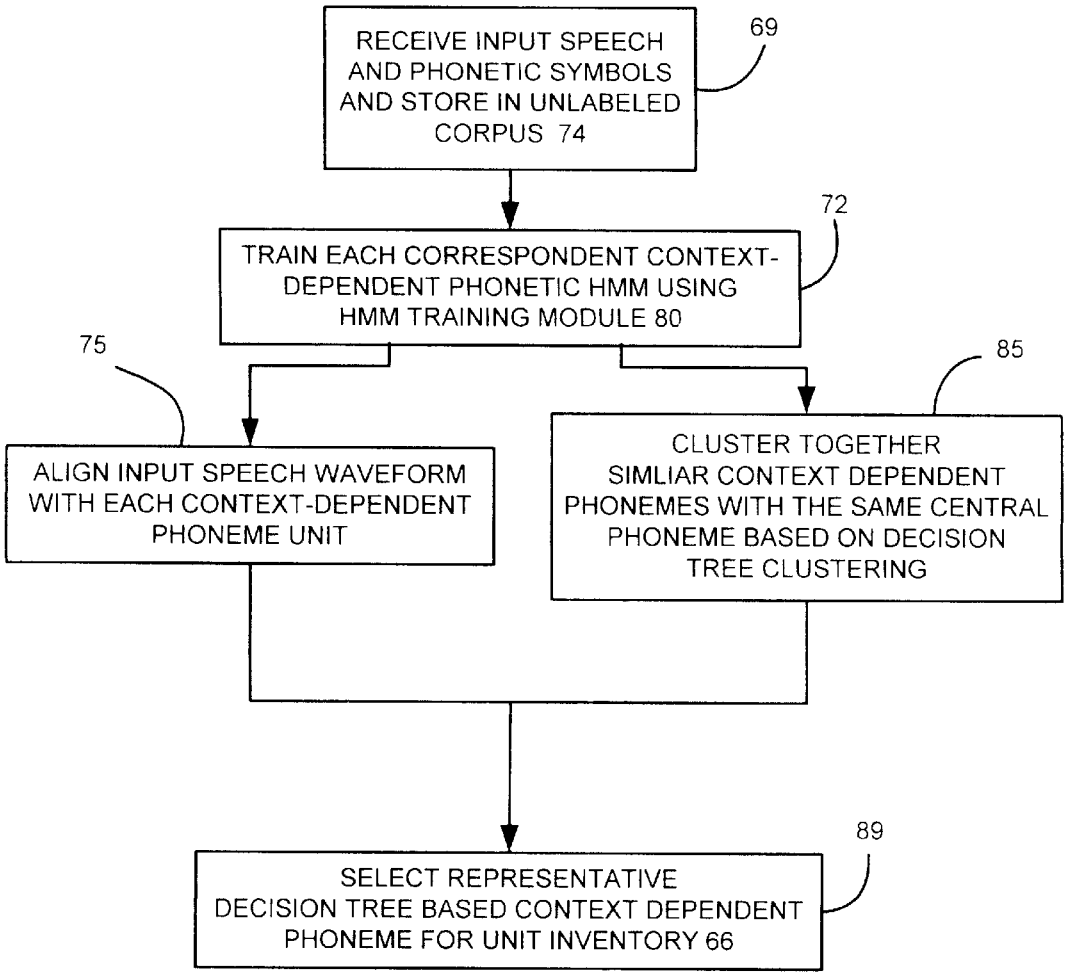
FIG. 3 is a flow diagram of steps performed for obtaining representative phoneme-based units for synthesis.

FIG. 3 illustrates a method for obtaining representative decision tree based context-dependent phoneme-based units for synthesis. Step 69 represents the acquisition of input speech from the target speaker and phonetic symbols that are stored in the unlabeled corpus 74. Step 72 will train each correspondent context-dependent phonetic HMM using a forward-backward training module. The HMM training module 80 can receive the phonetic symbols (i.e. a phonetic transcription) via a transcription input device such as computer keyboard 40. However, if transcription is performed remote from the computer 20 illustrated in FIG. 1, then the phonetic transcription can be provided through any of the other input devices illustrated, such as the magnetic disc drive 28 or the optical disk drive 30. After step 72, an HMM is created for each unique context-dependent phoneme-based unit. In one preferred embodiment, triphones (a phoneme with its one immediately preceding and succeeding phonemes as the context) are used for context-dependent phoneme-based units; where for each unique triphone in the unlabeled corpus 74, a correspondent HMM will be generated in module 80 and stored in the HMM database 82. If training data permits, one can further model quinphones (a phoneme with its two immediately preceding and succeeding phonemes as the context). In addition, other contexts affecting phoneme realization such as syllables, words or phrases can be modeled with as a separate HMMs following the same procedure. Likewise, diphones can be modeled with context-dependent HMMs as the immediately preceding or succeeding phoneme context. As used herein, a diphone is also a phoneme-based unit.

Figure 4:
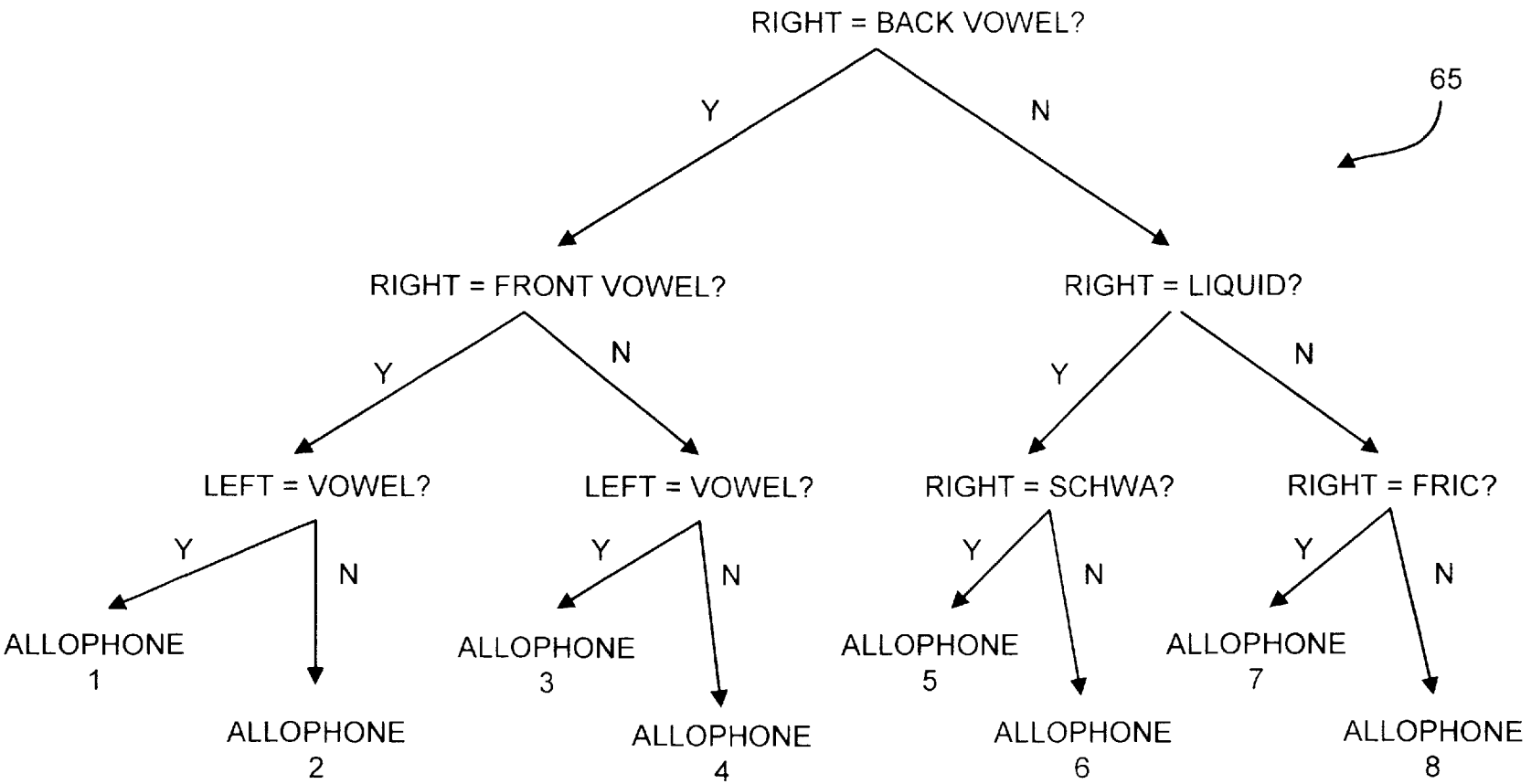
FIG. 4 is a pictorial representation of an exemplary decision tree.

After a HMM has been created for each context-dependent phoneme-based unit, for example, a triphone, a clustering module 84 receives as input the HMM database 82 and clusters similar, but different context-dependent phoneme-based HMM's together with the same central phoneme, for example, different triphones at step 85. In one embodiment as illustrated in FIG. 3, a decision tree (CART) is used. As is well known in the art, the English language has approximately 45 phonemes that can be used to define all parts of each English word. In one embodiment of the present invention, the phoneme-based unit is one phoneme so a total of 45 phoneme decision trees are created and stored at 67. A phoneme decision tree is a binary tree that is grown by splitting a root node and each of a succession of nodes with a linguistic question associated with each node, each question asking about the category of the left (preceding) or right (following) phoneme. The linguistic questions about a phoneme's left or right context are usually generated by an expert linguistic in a design to capture linguistic classes of contextual affects. The linguistic question can also be generated automatically with an ample HMM database. An example of a set of linguistic questions can be found in an article by Hon and Lee entitled "CMU Robust Vocabulaory-Independent Speech Recognition System," IEEE International Conference on Acoustics, Speech and Signal Processing, Toronto, Canada, 1991, pages 889–892, which is illustrated in FIG. 4 and discussed below.

In order to split the root node or any subsequent nodes, the clustering module 84 must determine which of the numerous linguistic questions is the best question for the node. In one embodiment, the best question is determined to be the question that gives the greatest entropy decrease of HMM's probability density functions between the parent node and the children nodes.

Using the entropy reduction technique, each node is divided according to whichever question yields the greatest entropy decrease. All linguistic questions are yes or no questions, so children nodes result in the division of each node. FIG. 4 is an exemplary pictorial representation of a decision tree for the phoneme /k/, along with some actual questions. Each subsequent node is then divided according to whichever question yields the greatest entropy decrease for the node. The division of nodes stops according to predetermined considerations. Such considerations may include when the number of output distributions of the node falls below a predetermined threshold or when the entropy decrease resulting from a division falls below another threshold. Using entropy reduction as a basis, the question that is used divides node m into node a and b, such that $$P(m)H(m)-P(a)H(a)-P(b)H(b) \text{ is maximized}$$

$$H(x) = -\sum_{c}^{C} p(c|x)\log P(c|x)$$

where H(x) is the entropy of the distribution in HMM model x, P(x) is the frequency (or count) of a model, and P(c|x) is the output probability of codeword c in model x. When the predetermined consideration is reached, the nodes are all leaf nodes representing clustered output distributions (instances) of phonemes having different context but of similar sound, and/or multiple instances of the same phoneme. If a different phoneme-based unit is used such as a diphone, then the leaf nodes represent diphones of similar sound having adjoining diphones of different context.

Using a single linguistic question at each node results in a simple tree extending from the root node to numerous leaf nodes. However, a data fragmentation problem can result in which similar triphones are represented in different leaf nodes. To alleviate the data fragmentation problem, more complex questions are needed. Such complex questions can be created by forming composite questions based upon combinations of the simple linguistic questions.

Generally, to form a composite question for the root node, all of the leaf nodes are combined into two clusters according to whichever combination results in the lowest entropy as stated above. One of the two clusters is then selected, based preferably on whichever cluster includes fewer leaf nodes. For each path to the selected cluster, the questions producing the path in the simple tree are conjoined. All of the paths to the selected cluster are disjoined to form the best composite question for the root node. A best composite question is formed for each subsequent node according to the foregoing steps. In one embodiment, the algorithm to generate a decision tree for a phoneme is given as follows:

1. Generate an HMM for every triphone;
2. Create a tree with one (root) node, consisting of all triphones;
3. Find the best composite question for each node:
   (a) Generate a tree with simple questions at each node;
   (b) Cluster leaf nodes into two classes, representing the composite questions;
4. Until some convergence criterion is met, go to step 3.

The creation of decision trees using linguistic questions to minimize entropy is described in co-pending application entitled "SENONE TREE REPRESENTATION AND EVALUATION", filed May 2, 1997, having Ser. No. 08/850,061, issued as U.S. Pat. No. 5,794,197 on Aug. 11, 1998 which is incorporated herein by references in its entirety. The decision tree described therein is for senones. A senone is a context-dependent sub-phonetic unit which is equivalent to a HMM state in a triphone. Besides using decision trees for clustering, other known clustering techniques such as K-means, can be used. Also, sub-phonetic clustering of individual states of senones can also be performed. This technique is described by R. E. Donovan et al. In "Improvements in an HMM-Based Speech Synthesizer", Proc. Eurospeech '95, pp. 573–576. However, this technique requires modeling, clustering and storing of multiple states in a Hidden Markov Model for each phoneme. When converting text-to-speech, each state is synthesized, resulting in a multiple concatenation points, which can increase distortion.

After clustering, one or more representative instances (a phoneme instance in the case of triphones) in each of the clustered leaf nodes are preferably chosen so as to further reduce memory resources during run-time at step 89. To select a representative instance from the clustered phonemes instances, statistics can be computed for amplitude, pitch and duration for the clustered phonemes. Any instance considerably far away from the mean can be automatically removed. Of the remaining phonemes, a small number can be selected through the use of an objective function. In one embodiment, the objective function is based on HMM scores. During run-time, a unit concatenation module 88 can either concatenate the best preselected context-dependent phoneme-based unit (instance) by the data acquisition and analysis system 62 or dynamically select the best context-dependent phoneme-based unit available representing the clustered context-dependent phoneme-based units that minimizes a joint distortion function. In one embodiment, the joint distortion function is a combination of HMM score, phoneme-based unit concatenation distortion and prosody mismatch distortion. Use of multiple representatives can significantly improve the naturalness and overall quality of the synthesized speech, particularly over traditional single instance diphone synthesizers. The representative instance or instances for each of the clusters are stored in the unit inventory 68.

Generation of speech from text is illustrated in the run-time engine 64 of FIG. 2. Text to be converted to speech is provided as an input 90 to a text analyzer 92. The text analyzer 92 performs text normalization which expands abbreviations to their formal forms as well as expands numbers, monetary amounts, punctuation and other non-alphabetic characters into their full word equivalents. The text analyzer 92 then converts the normalized text input to phonemes by known techniques. The string of phonemes is then provided to the prosody parameter generator 73 to assign accentual parameters to the string of phonemes. In the embodiment illustrated, templates stored in the prosody templates 66 are used to generate prosodic parameters.

The unit concatenation module 88 receives the phoneme string and the prosodic parameters. The unit concatenation module 88 constructs the context-dependent phonemes in the same manner as performed by the HMM training module 80 based on the context of the phoneme-based unit, for example, grouped as triphones or quinphones. The unit concatenation module 88 then selects the representative instance from the unit inventory 68 after working through the corresponding phoneme decision tree stored in the decision trees 67. Acoustic models of the selected representative units are then concatenated and outputted through a suitable interface such as a digital-to-analog converter 94 to the speaker 45.

The present system can be easily scaled to take advantage of memory resources available because clustering is performed to combine similar context-dependent phoneme-based sounds, while retaining diversity when necessary. In addition, clustering in the manner described above with decision trees allows phoneme-based units with contexts not seen in the training data, for example, unseen triphones or quinphones, to still be synthesized based on closest units determined by context similarity in the decision trees.

Although the present invention has been described with reference to preferred embodiments, workers skilled in the art will recognize that changes may be made in form and detail without departing from the spirit and scope of the invention. For instance, besides HMM modeling of phoneme-based units, one can use other known modeling techniques such as Gaussian Distribution and neural networks.

What is claimed is:

1. A method for generating speech from text, comprising the steps of:

storing a set of decision tree context-dependent phoneme-based units of a target speaker, wherein a central phoneme-based unit is selected from a group consisting of a phoneme and a diphone, wherein each context-dependent phoneme-based unit is arranged based on context of at least one immediately preceding and succeeding phoneme-based unit, and wherein one context-dependent phoneme-based unit is chosen to represent each leaf node in the decision trees;

obtaining a string of phonetic symbols representative of a text to be converted to speech;

selecting stored decision-tree based context-dependent phoneme-based units from the set of decision tree based context-dependent phoneme-based units based on the contexts of the phonetic symbols; and synthesizing the selected context-based phoneme-based units to generate speech corresponding to the text.

2. The method of claim 1 wherein phoneme-based unit comprises a phoneme and wherein the context-dependent phoneme-based unit is a triphone, a phoneme in the context of the one immediately preceding and succeeding phonemes.

3. The method of claim 1 wherein the phoneme-based unit comprises a phoneme and wherein the context-dependent phoneme-based unit comprises a quinphone, a phoneme in the context of the two immediately preceding and succeeding phonemes.

4. The method of claim 1 wherein the step of storing includes storing at least two decision tree based context-dependent phoneme-based units representing other non-stored context-dependent phoneme-based units of similar sound due to similar contexts, and wherein the step of selecting includes selecting one of said at least two decision tree base context-dependent phoneme-based units to minimize a joint distortion function.

5. The method of claim 4 wherein the joint distortion function comprises at least one of a HMM score, phoneme-based unit concatenation distortion and prosody mismatch distortion.

6. The method of claim 1 wherein each decision tree includes: a root node corresponding to one of the plurality of phoneme-based units spoken by the target speaker; leaf nodes corresponding to decision tree based context-dependent phoneme-based units; and linguistic questions to traverse the decision tree from the root node to the leaf nodes; and wherein the step of selecting includes traversing the decision trees to select the stored decision tree based context-dependent phoneme-based units.

7. The method of claim 6 wherein the linguistic questions comprise complex linguistic questions.

8. An apparatus for generating speech from text, comprising:

storage means for storing a set of decision tree based context-dependent phoneme-based units of a target speaker, wherein a central phoneme-based unit is selected from a group consisting of a phoneme and a diphone, wherein each context-dependent phoneme-based unit is arranged based on context of at least one immediately preceding and succeeding phoneme-based unit, and wherein at least one of the context-dependent phoneme-based units represents other non-stored context-dependent phoneme-based units of similar sound due to similar contexts;

a text analyzer for obtaining a string of phonetic symbols representative of a text to be converted to speech; and a concatenation module for selecting stored decision tree base context-dependent phoneme-based units from the set of decision tree based context-dependent phoneme-based units based on the context of the phonetic symbols and synthesizing the selected context-dependent phoneme-based units to generate speech corresponding to the text.

9. The apparatus of claim 8 wherein the phoneme-based unit comprises a phoneme and wherein the context-dependent phoneme-based unit is a triphone, a phoneme in the context of the one immediately preceding and succeeding phonemes.

10. The apparatus of claim 8 wherein the phoneme-based unit comprises a phoneme and wherein the context-dependent phoneme-based unit comprises a quinphone, a phoneme in the context of the two immediately preceding and succeeding phonemes.

11. The apparatus of claim 8 wherein the storage means includes at least two decision tree based context-dependent phoneme-based units representing other non-stored decision tree base context-dependent phoneme-based units of similar sound due to similar context, and wherein the concatenation module selects one of said at least two decision tree based context-dependent phoneme-based units to minimize a joint distortion function.

12. The apparatus of claim 11 wherein the joint distortion function comprises at least one of a HMM score, phoneme-based unit concatenation distortion and prosody mismatch distortion.

13. The apparatus of claim 8 wherein each decision tree includes: a root node corresponding to one of the plurality of phoneme-based units spoken by the target speaker; leaf nodes corresponding to stored to decision tree based context-dependent phoneme-based units; and linguistic questions to traverse the decision tree from the root node to the leaf nodes.

14. The apparatus of claim 13 wherein the linguistic questions comprise complex linguistic questions.

15. A method for creating context dependent synthesis units of a text-to-speech system, the method comprising the steps of:

storing input speech from a target speaker and corresponding phonetic symbols of the input speech;

identifying each unique context-dependent phoneme-based unit of the input speech, wherein a central phoneme-based unit is selected from a group consisting of a phoneme and a diphone;

training a Hidden Markov Model (HMM) for each unique context-dependent phoneme-based unit based on context of at least one immediately preceding and succeeding phoneme-based units;

clustering the HMMs into groups having the same central phoneme-based unit that sound similar but have different preceding or succeeding phoneme-based units; and selecting a context-dependent phoneme-based unit of each group to represent the corresponding group.

16. The method of claim 15 wherein the step of selecting includes selecting at least two context-dependent phoneme-based units to represent at least one of the groups.

17. The method of claim 15 wherein the phoneme-based unit comprises a phoneme and wherein the context-dependent phoneme-based unit is a triphone, a phoneme in the context of the one immediately preceding and succeeding phonemes.

18. The method of claim 15 wherein context-dependent phoneme-based unit comprises a phoneme and wherein the context comprises a quinphone, a phoneme in the context of the two immediately preceding and succeeding phonemes.

19. The method of claim 15 wherein the step of clustering includes k-means clustering.

20. The method of claim 19 wherein the step of clustering includes forming a decision tree for each central phoneme-based unit spoken by the target speaker, wherein each decision tree includes: a root node corresponding to one of the plurality of phoneme-based units spoken by the target speaker; leaf nodes corresponding to clustered HMMs; and linguistic questions to traverse the decision tree from the root node to the leaf nodes.

21. The method of claim 20 wherein the linguistic questions comprise complex linguistic questions.

22. An apparatus for creating context dependent synthesis phoneme-based units of a text-to-speech system, the method comprising the steps of:

means for storing input speech from a target speaker and corresponding phonetic symbols of the input speech;

a training module for identifying each unique context-dependent phoneme-based unit of the input speech and training a Hidden Markov Model (HMM) for each unique context-dependent phoneme-based unit based on context of at least one immediately preceding and succeeding phoneme-based unit, wherein a central phoneme-based unit is selected from a group consisting of a phoneme and a diphone;

a clustering module for clustering the HMMs into groups having the same central phoneme-based unit that sound similar but have different preceding or succeeding phoneme-based units and selecting one of context-dependent phoneme-based unit of each group to represent the corresponding group.

23. The apparatus of claim 22 wherein the clustering module selects at least two context-dependent phoneme-based units to represent at least one of the groups.

24. The apparatus of claim 22 wherein the phoneme-based unit comprises a phoneme and wherein the context-dependent phoneme-based unit is a triphone, a phoneme in the context of the one immediately preceding and succeeding phonemes.

25. The apparatus of claim 22 wherein the phoneme-based unit comprises a phoneme and wherein the context-dependent phoneme-based unit comprises a quinphone, a phoneme in the context of the two immediately preceding and succeeding phonemes.

26. The apparatus of claim 22 wherein the clustering module clusters HMMs using k-means clustering.

27. The apparatus of claim 26 wherein the clustering module forms a decision tree for each central phoneme-based unit spoken by the target speaker, wherein each decision tree includes: a root node corresponding to one of the plurality of phoneme-based units spoken by the target speaker; leaf nodes corresponding to clustered HMMs; and linguistic questions to traverse the decision tree from the root node to the leaf nodes.

28. The apparatus of claim 27 wherein the linguistic questions comprise complex linguistic questions.

29. A method for generating speech from text, comprising the steps of:

storing a set of HMM context-dependent phoneme-based units of a target speaker, wherein a central phoneme-based unit is selected from a group consisting of a phoneme and a diphone, wherein each HMM context-dependent phoneme-based unit is arranged based on context of at least one immediately preceding and succeeding phoneme-based unit, and wherein at least one of the HMM context-dependent phoneme-based units represents other non-stored HMM context-dependent phoneme-based units of similar sound due to context;

obtaining a string of phonetic symbols representative of a text to be converted to speech;

selecting stored HMM context-dependent phoneme-based units from the set of HMM context-dependent phoneme-based units based on the context of the phonetic symbols; and synthesizing the selected HMM context-dependent phoneme-based units to generate speech corresponding to the text.

30. The method of claim 29 wherein the phoneme-based unit comprises a phoneme and wherein the context-dependent phoneme-based unit is a triphone.

31. The method of claim 29 wherein the phoneme-based unit comprises a phoneme and wherein the context-dependent phoneme-based unit comprises a quinphone.

* * * * *

UNITED STATES PATENT AND TRADEMARK OFFICE

CERTIFICATE OF CORRECTION

PATENT NO. : 6,163,769
DATED : December 19, 2000
INVENTOR(S) : Acero et al.

It is certified that error appears in the above-identified patent and that said Letters Patent is hereby corrected as shown below:

Column 9,
Lines 38 and 57, change "base" to -- based --.

Column 10,
Line 2, delete "to" second occurrence.

Signed and Sealed this

Thirtieth Day of October, 2001

*Attest:*

Nicholas P. Godici

NICHOLAS P. GODICI
*Acting Director of the United States Patent and Trademark Office*

*Attesting Officer*